US011124999B2

(12) United States Patent
Curry

(10) Patent No.: US 11,124,999 B2
(45) Date of Patent: Sep. 21, 2021

(54) ADJUSTABLE DOOR HINGE MECHANISM

(71) Applicant: snap-on incorporated, Kenosha, WI (US)

(72) Inventor: David D. Curry, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 16/680,180

(22) Filed: Nov. 11, 2019

(65) Prior Publication Data

US 2021/0140211 A1 May 13, 2021

(51) Int. Cl.
*E05D 7/04* (2006.01)

(52) U.S. Cl.
CPC ..... *E05D 7/0415* (2013.01); *E05Y 2201/722* (2013.01); *E05Y 2900/132* (2013.01); *E05Y 2900/20* (2013.01)

(58) Field of Classification Search
CPC ..... E05D 7/0415; E05Y 2201/722; E05Y 2900/132; E05Y 2900/20
See application file for complete search history.

(56) References Cited

U.S. PATENT DOCUMENTS

| | | | | |
|---|---|---|---|---|
| 1,037,807 A | | 9/1912 | Thurber | |
| 3,251,088 A | | 5/1966 | Boundy | |
| 3,251,090 A | | 5/1966 | Fergison | |
| 4,765,027 A | * | 8/1988 | Andric | E05D 3/122 16/354 |
| 5,943,736 A | * | 8/1999 | Karkkainen | E05F 3/102 16/62 |
| 7,240,400 B2 | | 7/2007 | Bonham | |
| 8,186,010 B2 | * | 5/2012 | Tomiji | E05F 5/027 16/64 |
| 8,347,459 B2 | | 1/2013 | Heisig | |
| 8,707,517 B2 | | 4/2014 | Hofer | |
| 2004/0145284 A1 | * | 7/2004 | Egger | E05F 5/02 312/331 |
| 2005/0251961 A1 | | 11/2005 | Liu | |
| 2009/0071075 A1 | | 3/2009 | Hoffmann | |

FOREIGN PATENT DOCUMENTS

| | | | |
|---|---|---|---|
| DE | 1942714 | A1 | 12/1970 |
| DE | 3807729 | A1 | 9/1989 |
| DE | 19649352 | | 6/1998 |
| DE | 102004007823 | A1 | 9/2005 |

(Continued)

OTHER PUBLICATIONS

Australian Examination Report No. 1 for corresponding Australian Application No. 2020264327 dated Jun. 29, 2021, 6 pages.

(Continued)

*Primary Examiner* — Victor D Batson
*Assistant Examiner* — Matthew J Sullivan
(74) *Attorney, Agent, or Firm* — Seyfarth Shaw LLP

(57) ABSTRACT

An adjustable door hinge that includes a rack and pinion gear set that is adapted to adjust hinge alignment relative to a door frame/case. As the pinion gear is rotated, a set of gear racks acts as a set of tapered wedges that change the alignment of the hinge relative to the door frame/case. Once the desired alignment of the hinge is reached, hinge mounting screws can be tightened to releasably couple the assembly in the proper alignment/location.

18 Claims, 9 Drawing Sheets

(56) References Cited

FOREIGN PATENT DOCUMENTS

| | | | | |
|---|---|---|---|---|
| DE | 202006000574 | U1 | | 4/2006 |
| DE | 102008003557 | A1 | * | 7/2009 |
| DE | 102017119011 | A1 | | 2/2019 |
| EP | 318422 | A1 | * | 5/1989 |
| EP | 1619337 | A2 | | 1/2006 |
| EP | 2993290 | A2 | | 3/2016 |
| FR | 2703099 | | | 9/1994 |
| JP | 04070480 | | | 3/1992 |
| JP | 08028130 | | | 1/1996 |
| JP | 08068255 | | | 3/1996 |
| JP | 2004324059 | | | 11/2004 |

OTHER PUBLICATIONS

United Kingdom Combined Search and Examination Report for corresponding UK Application No. GB2017754.9 dated Apr. 15, 2021, 9 pages.

* cited by examiner

ADJUSTABLE DOOR HINGE MECHANISM

TECHNICAL FIELD OF THE INVENTION

The present invention relates generally to door hinge mechanisms. More particularly, the present invention relates to adjustable door hinge mechanisms.

BACKGROUND OF THE INVENTION

A variety of doors and hinges are commonly used on walls, cabinets, storage boxes, etc. However, it can be difficult to properly align the door relative to the opening with a conventional door hinge. Some current hinges include oversized holes or slots at the mounting locations to allow adjustability. This allows the position of the hinge with respect to the door frame to be slightly adjusted. However, over time, especially in connection with vertically hung or heavy doors, the hinge screws can be come loose. This loosening can cause the hinge to shift, and result in the door being misaligned.

SUMMARY OF THE INVENTION

The present invention relates broadly to adjustable door hinge mechanisms. For example, a mechanism includes a rack and pinion gear set that cooperatively adjusts hinge alignment relative to a door frame/case. As the pinion gear is rotated, a set of gear racks acts as tapered wedges that change the alignment of the hinge relative to the door frame/case. Once the desired alignment of the hinge is obtained, hinge mounting screws can be tightened to releasably couple the assembly in the desired alignment/location.

In an embodiment, an adjustable hinge mechanism includes a body including first and second channels. First and second gear racks are respectively disposed in the first and second channels; and a gear is disposed between the first and second gear racks. Rotation of the gear moves the first gear rack in a first direction and moves the second gear rack in a second direction opposite the first direction.

In another embodiment, an adjustable hinge mechanism incudes a body with first and second channels. First and second gear racks are respectively disposed in the first and second channels. Each of the first and second gear racks is tapered from a first end towards a second end, and each of the first and second gear racks includes rack teeth facing each other. A gear including gear teeth is disposed between the first and second gear racks and in meshing engagement with the rack teeth. Rotation of the gear moves the first gear rack in a first direction and moves the second gear rack in a second direction opposite the first direction.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
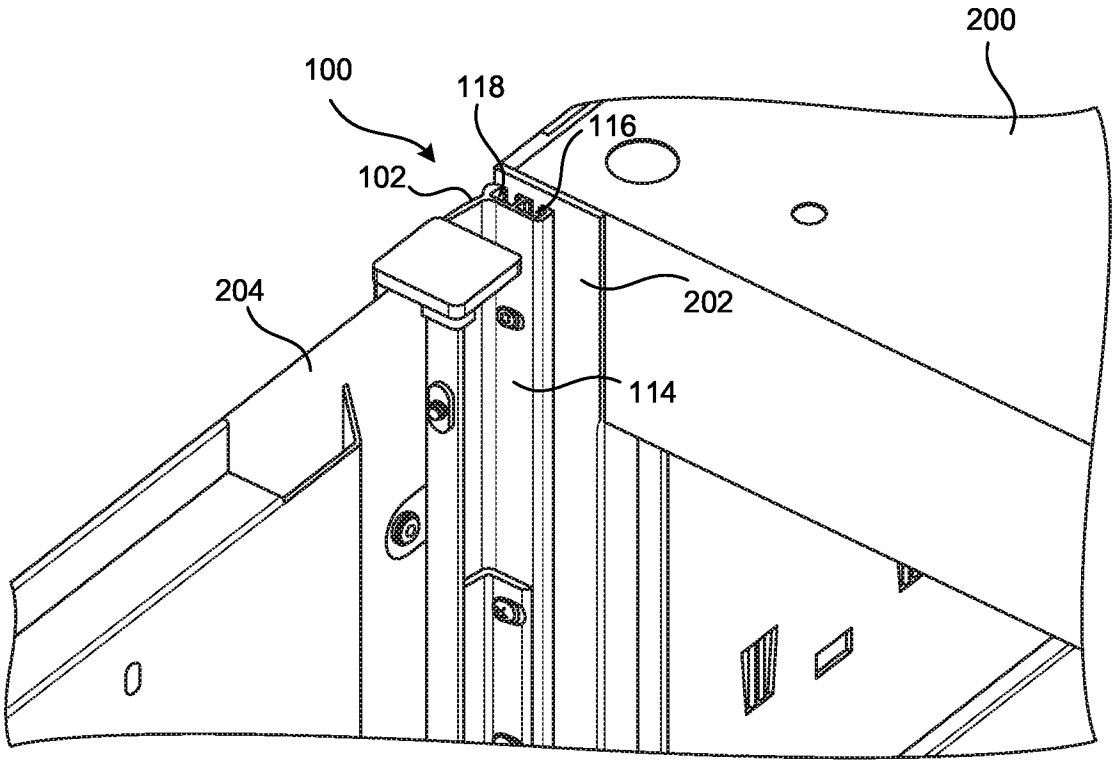
FIG. 1 is a partial perspective side view of an adjustable hinge mechanism coupled to a frame in accordance with an embodiment of the present invention.
Figure 2:
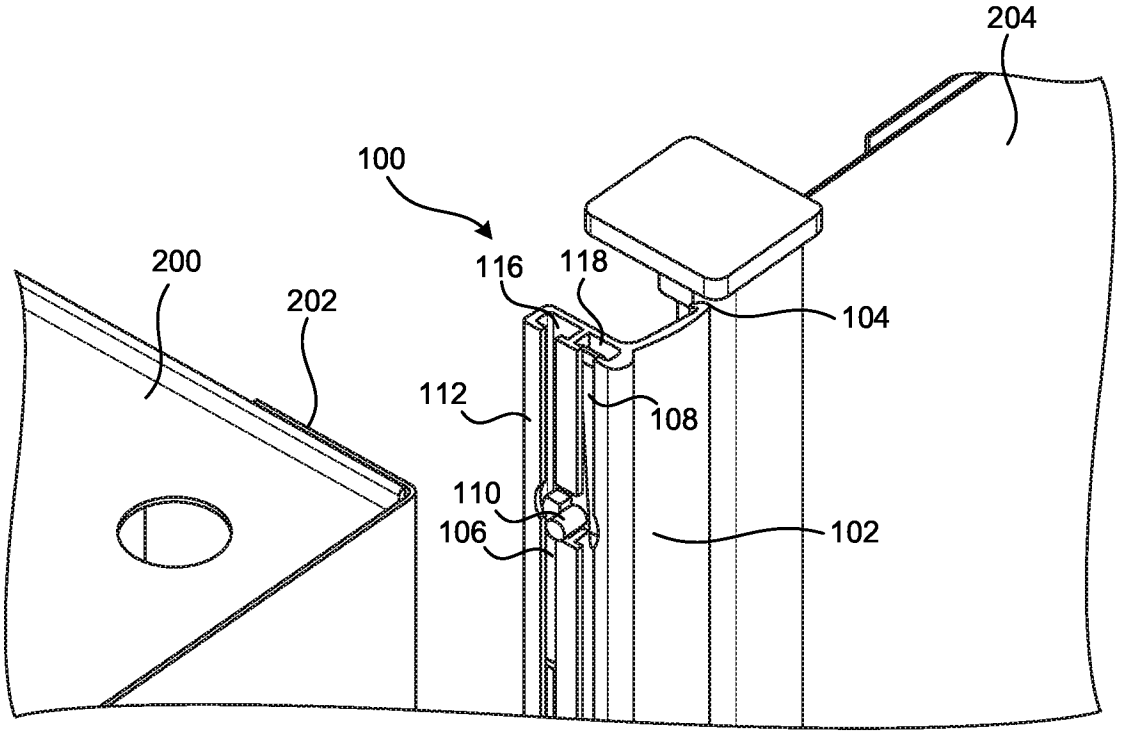
FIG. 2 is a first partial perspective side view of the adjustable hinge mechanism removed from the frame in accordance with an embodiment of the present invention.
Figure 3:
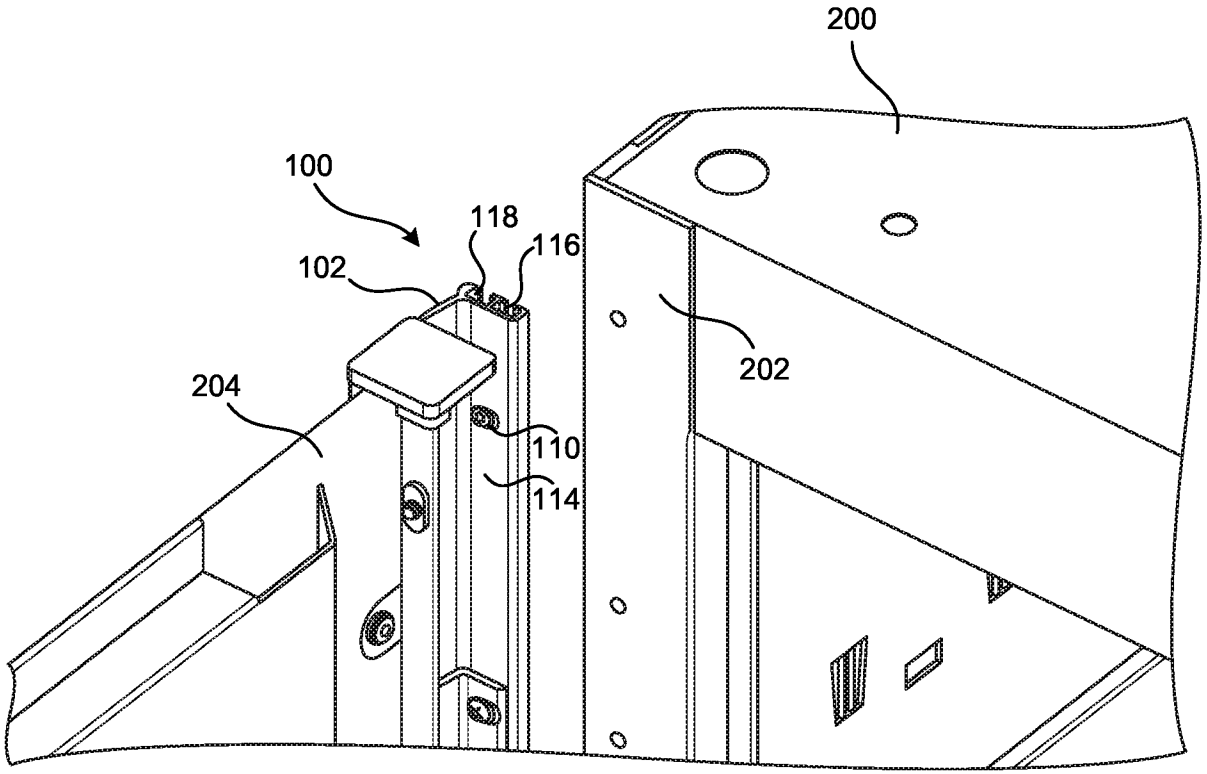
FIG. 3 is a second partial perspective view of the adjustable hinge mechanism removed from the frame in accordance with an embodiment of the present invention.
Figure 4:
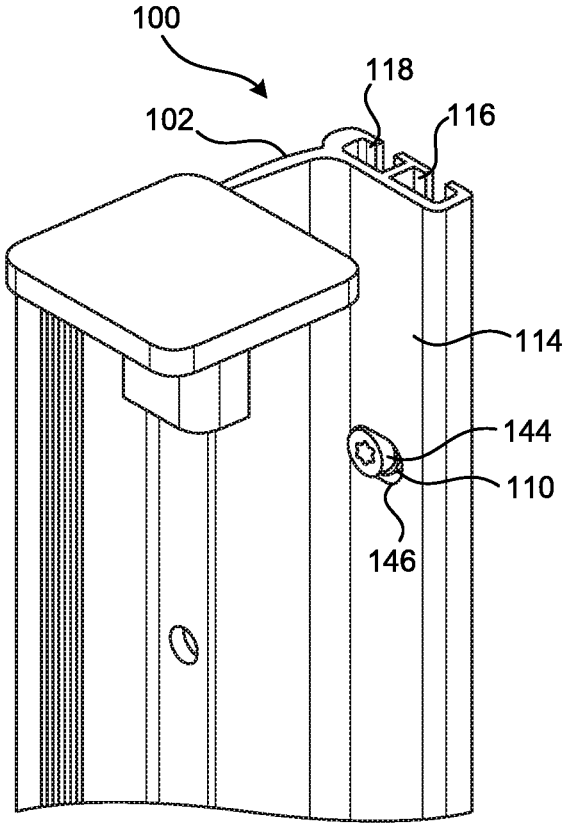
FIG. 4 is a first partial perspective side view of an end of the adjustable hinge mechanism in accordance with an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention relates broadly to adjustable door hinge mechanisms. For example, the present invention broadly comprises a rack and pinion gear set that cooperatively adjusts hinge alignment relative to a door frame/case or other storage container. As the pinion gear is rotated, a set of gear racks acts as a set of tapered toothed wedges that change the lateral or vertical alignment of the hinge with respect to the door frame/case. Once the desired alignment of the hinge is obtained, hinge mounting screws can be tightened to releasably couple the assembly in the desired alignment/location.

Advantages of the present invention include, for example, reducing stress on mounting screws used for vertically hung doors and maintaining adjustability of hinges even after a period of time. By using the rack and pinion gear set mechanism of the present invention, the mounting screws only have to maintain the hinge assembly against the door frame/case. The mechanism can also be used to hold the hinge assembly alignment.

FIGS. 1-6 illustrate an embodiment of a hinge mechanism 100 adapted to be coupled to a door frame portion 202 of a case 200 (such as a cabinet, tool storage cabinet, or other type of openable and closeable compartment), and a door 204, of the present invention. The hinge mechanism 100 may also be coupled to a door frame of a wall or other structure. The hinge mechanism 100 includes a body 102 adapted to pivotably couple to the door 204 at a pivot portion 104, first and second gear racks 106, 108, and a gear 110 (such as a pinion gear). As illustrated, the body 102 has a substantially "L" shaped cross-section; however, the body 102 may have other cross sectional shapes without departing from the scope and spirit of the present invention.

Figure 5:
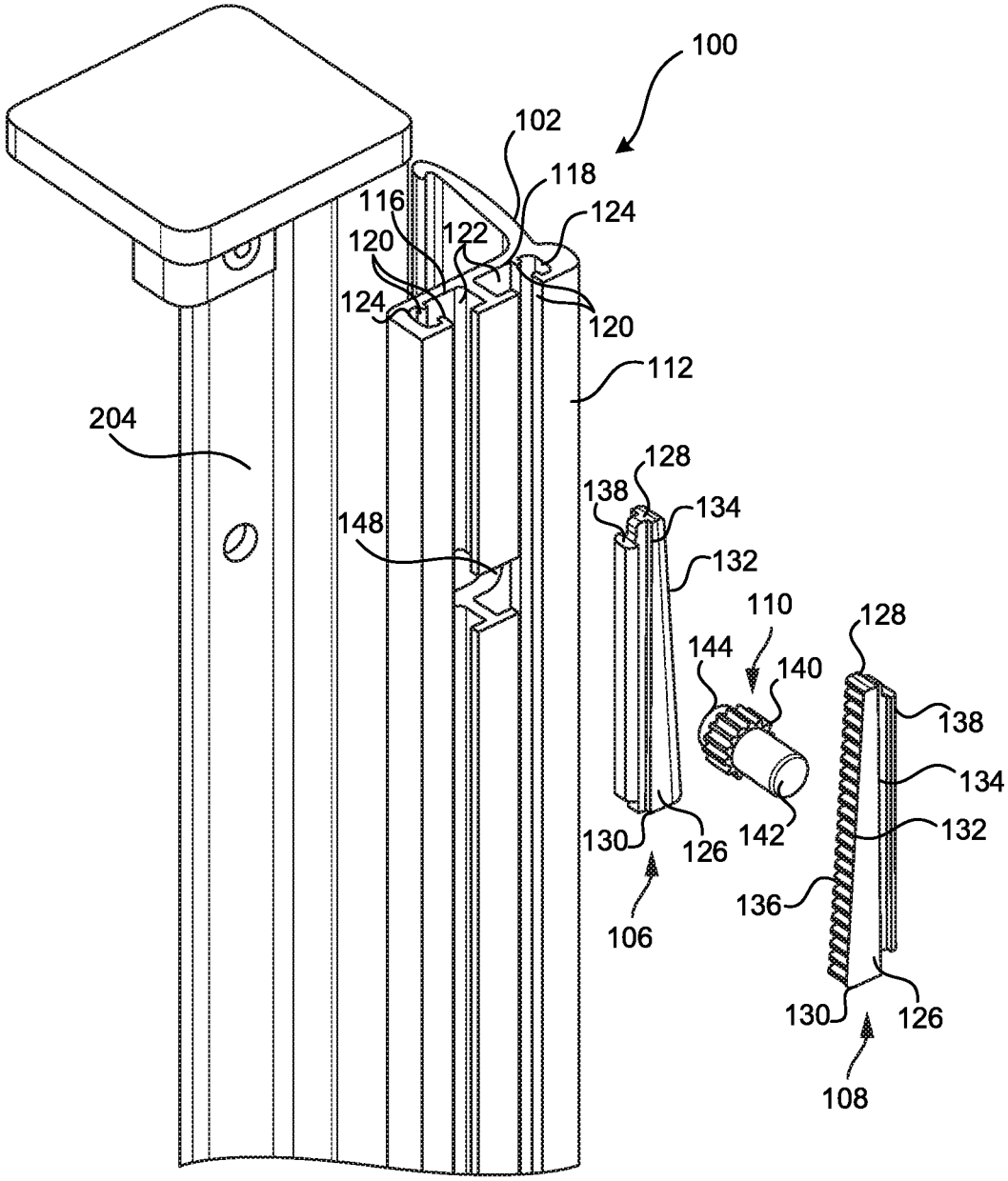
FIG. 5 is a partial exploded perspective side view of an end of the adjustable hinge mechanism in accordance with an embodiment of the present invention.
Figure 6:
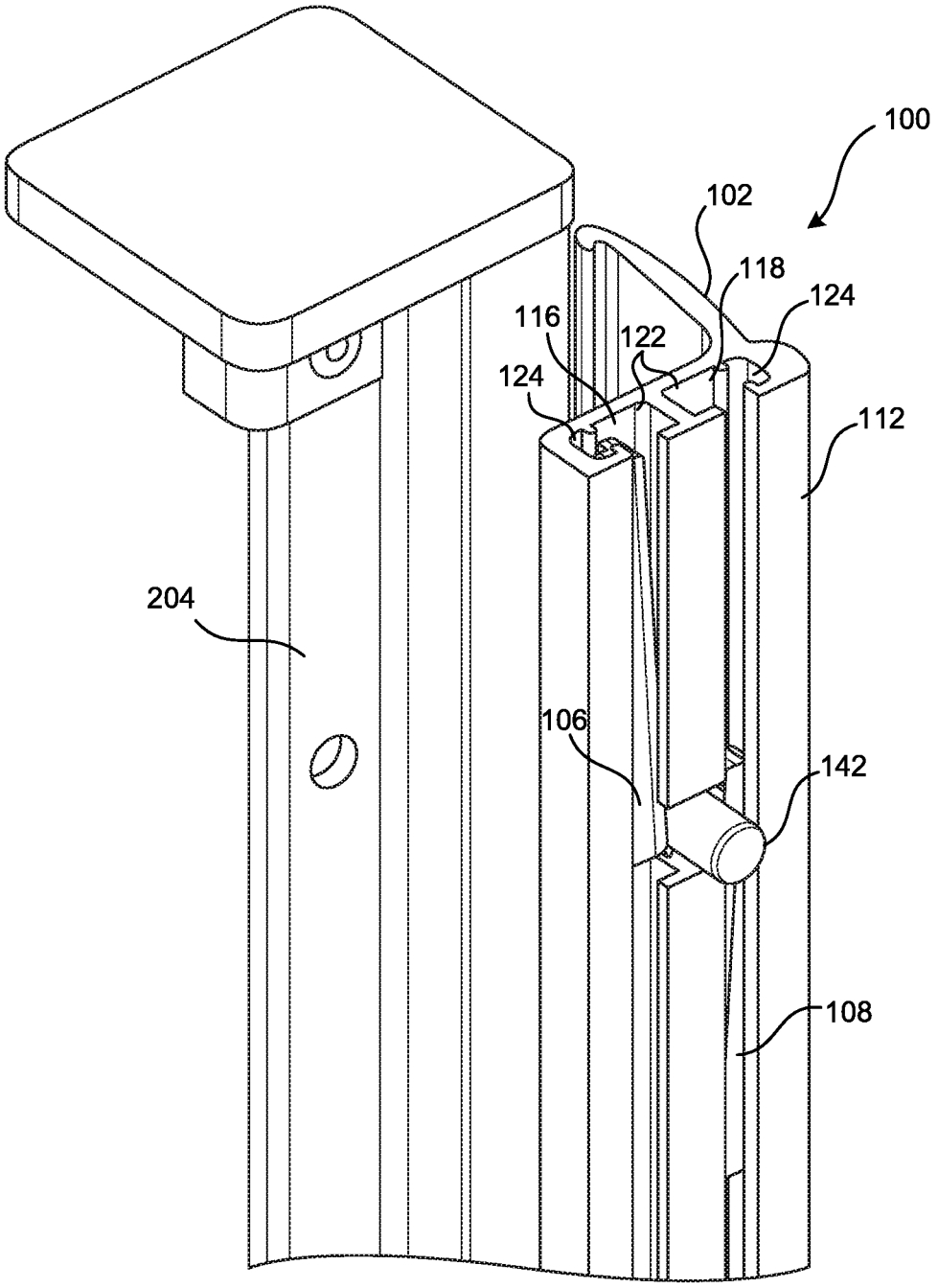
FIG. 6 is a second partial perspective side view of the end of the adjustable hinge mechanism in accordance with an embodiment of the present invention.
Figure 7:
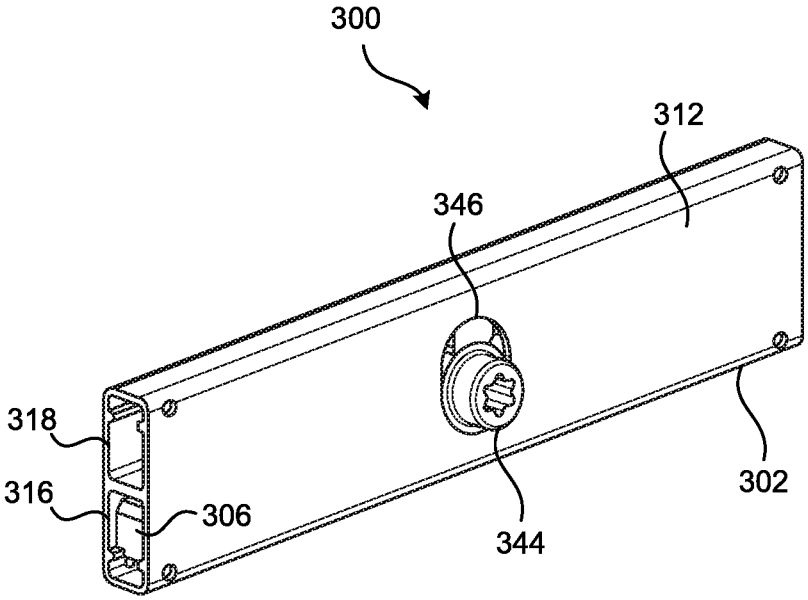
FIG. 7 is a perspective view of an adjustable hinge mechanism as a separate component in accordance with an embodiment of the present invention.
Figure 8:
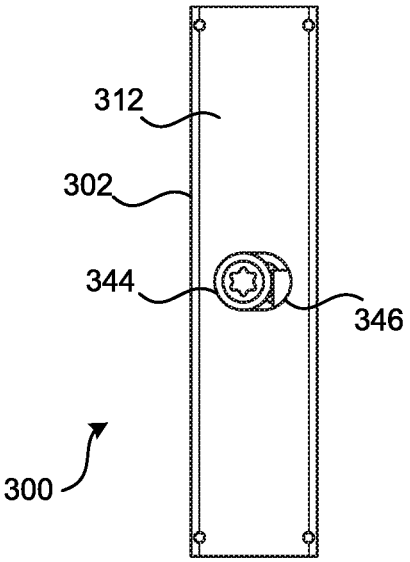
FIG. 8 is a side view of the adjustable hinge mechanism of FIG. 7.

The body 102 may include a first surface portion 112 adapted to face and abut the frame portion 202 when the hinge mechanism 100 is installed on the case 200. The body 102 may also include a second surface portion 114, opposite the first surface portion 112, adapted to face away from the frame portion 202 when the hinge mechanism 100 is installed on the case 200. First and second channels 116, 118 extend longitudinally relative to the body 102 and are disposed between the first and second surface portions 112, 114. As shown in FIGS. 5 and 6, in an embodiment, each of the first and second channels 116, 118 includes opposing inwardly extending flanges 120 with a gap between the opposing inwardly extending flanges 120. The inwardly extending flanges 120 partition the respective first and second channels 116, 118 into a first channel portion 122 and a second channel portion 124. For example, each of the first and second channels 116, 118 includes a first channel portion 122 and a second channel portion 124, which are described in further detail below.

Also as shown FIGS. 5 and 6, in an embodiment, each of the first and second gear racks 106, 108 includes a rack body 126 having first and second ends 128, 130. The rack body 126 is tapered between the respective first and second ends 128, 130, and the first end 128 has a first width smaller than a second width of the second end 130. The rack body 126 also includes first and second sides 132, 134 extending longitudinally between the first and second ends 128, 130. Rack teeth 136 are disposed on the first side 132, and a rack alignment feature 138 is disposed on and extends from the second side 134. The rack teeth 136 are adapted meshingly engage teeth of the gear 110, and the rack alignment feature 138 is adapted to mate with the second channel portion 124, as described below.

In an embodiment, the first gear rack 106 is adapted to be disposed in the first channel 116, with the rack body 126 being disposed longitudinally in the first channel portion 122, and the rack alignment feature 138 disposed in the second channel portion 124. The cross-sectional shapes of the rack alignment feature 138 and the second channel portion 124 are matingly shaped or keyed to allow the first gear rack 106 to slide longitudinally in the first channel 116, and restrict horizontal movement of the first gear rack 106 relative to the first channel 116. As shown, in an embodiment, the cross-sectional shapes of the rack alignment feature 138 and the second channel portion 124 are substantially "D" shaped, however, any other cross-sectional shapes may be used.

Similarly, in an embodiment, the second gear rack 108 is adapted to be disposed in the second channel 118, with the rack body 126 being disposed longitudinally in the first channel portion 122, and the rack alignment feature 138 disposed in the second channel portion 124. The rack teeth 136 of each of the first and second gear racks 106, 108 also face each other. The cross-sectional shapes of the rack alignment feature 138 and the second channel portion 124 are matingly shaped or keyed to allow the second gear rack 108 to slide longitudinally in the second channel 118, and restrict horizontal movement of the second gear rack 108 with respect to the second channel 118. Similarly, the cross-sectional shapes of the rack alignment feature 138 and the second channel portion 124 are substantially "D" shaped, however, any other cross-sectional shapes may be used. While the first and second gear racks 106, 108 are described as being slidable longitudinally in the respective first and second channels 116, 118, one or both of the first and second gear racks 106, 108 may be fixed in position to provide for horizontal and vertical alignment.

As illustrated, both of the first and second gear racks 106, 108 are positioned with the first ends 128 facing in a first direction, and the second ends 130 facing in a second direction opposite the first direction. For example, as shown in FIG. 6, in an embodiment, both of the first and second gear racks 106, 108 are positioned with the first ends 128 facing upwardly and the second end 130 facing downwardly. However, the first and second gear racks 106, 108 may be positioned with the first end 128 facing downwardly and the second end 130 facing upwardly.

The gear 110 includes a toothed portion 140 including gear teeth disposed circumferentially around the gear 110. A lug 142 protrudes from a first side of the toothed portion 140, and a fastener type head 144 is disposed on a second side of the toothed portion 140. The lug 142 is adapted to engage an aperture of the frame 202. The head 144 includes a recess or is otherwise adapted to mate with a tool driver, such as a flat, Torx, Phillips, hex, or other type of tool driver.

The gear 110 is disposed in the body 102 between the first and second gear racks 106, 108, with the toothed portion 140 in meshing engagement with the rack teeth 136 of both of the first and second gear racks 106, 108. Further, the head 144 is adapted to extend through a first aperture 146 in the body 102 and be disposed and accessible through the second surface portion 114. Similarly, the lug 142 is adapted to extend through a second aperture 148 in the body 102 and be disposed and extend through the first surface portion 112. The first and second apertures 146 and 148 are sized to provide clearance for the body 102 to move in a side-to-side direction with respect to the gear 110. For example, the first aperture 146 may be oblong and allow the body 102 to move horizontally with respect to the gear 110.

As shown in FIG. 6, in an embodiment, when the hinge mechanism 100 is assembled, the first and second gear racks 106, 108 are disposed in the respective first and second channels 116, 118 (as described above), and the gear 110 is disposed in the body 102 between the first and second gear racks 106, 108 (as described above). The toothed portion 140 of the gear 110 may be engaged with rack teeth 136 of the first gear rack 106 proximal to the second end 130 of the first gear rack 106; and the toothed portion 140 of the gear 110 may also be engaged with rack teeth 136 of the second gear rack 108 proximal to the first end 128 of the second gear rack 108. This allows for rotation of the gear 110, for example, by engaging a tool drive with the head 144, in clockwise or counter-clockwise directions. Rotation of the gear 110 causes one of the first and second gear racks 106, 108 to move in the first direction, and the other to move in the opposing second direction.

For example, rotation of the head 144 of the gear 110 in the clockwise direction causes the first gear rack 106 to move in the second direction (such as downwardly relative to the body 102) in the first channel 116, and the second gear rack 108 to move in the first direction (such as upwardly relative to the body 102) in the second channel 118. Similarly, rotation of the head 144 of the gear 110 in the counter-clockwise direction causes the first gear rack 106 to move in the first direction (such as upwardly relative to the body 102) in the first channel 116, and the second gear rack 108 to move in the second direction (such as downwardly relative to the body 102) in the second channel 118.

As mentioned above, the lug 142 of the gear 110 is engaged with the frame 202, when the hinge mechanism 100 is installed. Due to the tapered shapes of the first and second gear racks 106, 108, rotation of the gear 110 and thereby movement of the first and second gear racks 106, 108 relative to one another, causes the body 102 to move in a side-to-side direction relative to the frame 202. This allows for alignment of the body 102 relative to the frame 202. Once desired alignment of the body 102 relative to the frame 202 is obtained by rotation of the gear 110, fasteners can be inserted into the body 102 and frame 202 to releasably couple and hold the body 102 on the frame 202.

In another embodiment, the hinge mechanism may be an assembled component that is coupled to a hinge bracket. FIGS. 7-11 illustrate an embodiment of a hinge mechanism 300 adapted to be coupled to a door frame portion 202 of a case 200 (such as a cabinet, tool storage cabinet, or other type of openable and closeable compartment), and a door 204. The hinge mechanism 300 may also be coupled to a door frame of a wall or other structure. The hinge mechanism 300 includes a housing 302 (which may also be referred to as a body 302) adapted to couple to a hinge bracket 400, which pivotably couples to the door 204 at a pivot portion 404, first and second gear racks 306, 308, and a gear 310 (such as a pinion gear). As illustrated, the hinge bracket 400 has a substantially "L" shaped cross-section, however, the hinge bracket 400 may have other cross-sectional shapes as desired.

Figure 9:
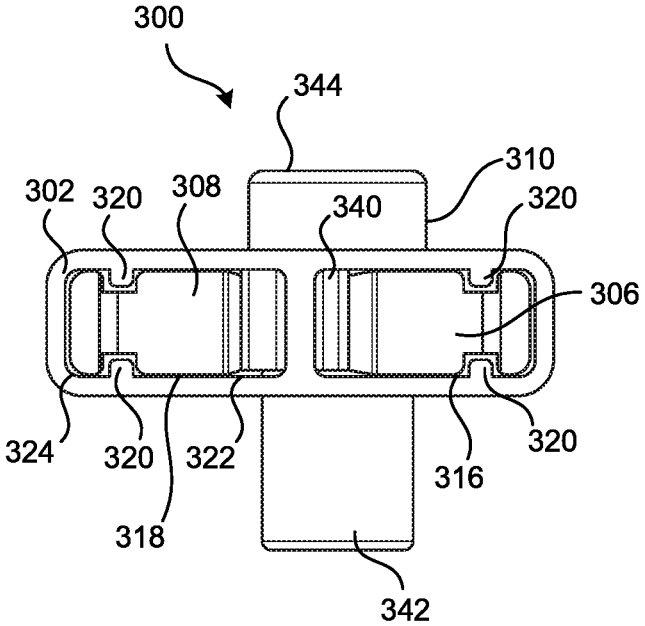
FIG. 9 is an end view of the adjustable hinge mechanism of FIG. 7.

The housing 302 (or body 302) may include a first surface portion 312 adapted to face and abut the frame portion 202 when the hinge mechanism 300 is installed on the case 200. The housing 302 may also include a second surface portion 314, opposite the first surface portion 312, adapted to face away from the frame portion 202 when the hinge mechanism 300 is installed on the case 200. First and second channels 316, 318 extend longitudinally through the housing 302 and are disposed between the first and second surface portions 312, 314. Referring to FIG. 9, in an embodiment, each of the first and second channels 316, 318 may include opposing inwardly extending flanges 320 with a gap between the opposing inwardly extending flanges 320. The inwardly extending flanges 320 partition the respective first and second channels 316, 318 into a first channel portion 322 and a second channel portion 324. For example, in an embodiment, each of the first and second channels 316, 318 includes a first channel portion 322 and a second channel portion 324, which are described in further detail below.

Figure 10:
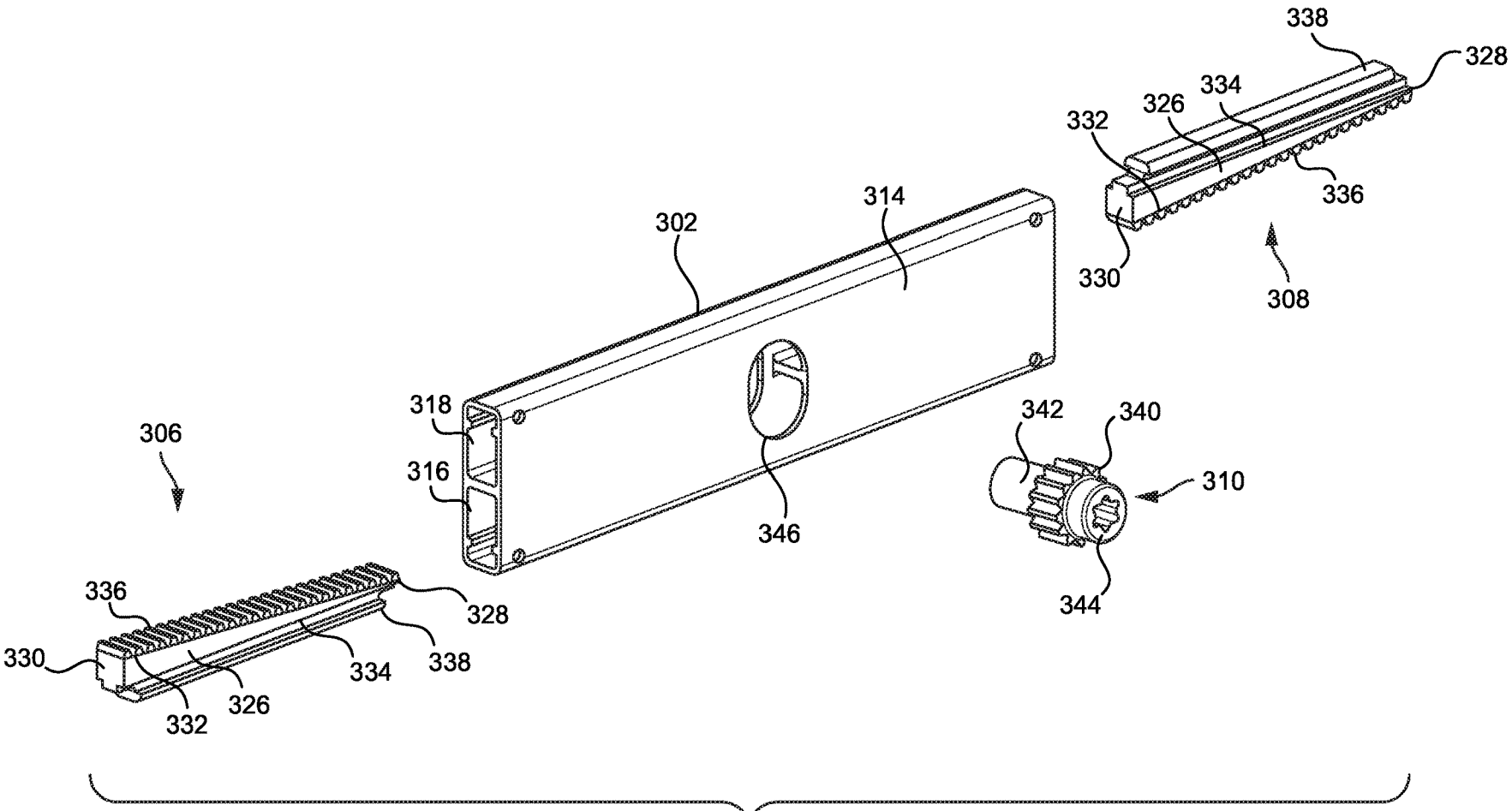
FIG. 10 is an exploded perspective view of the adjustable hinge mechanism of FIG. 7.

Referring to FIG. 10, in an embodiment, each of the first and second gear racks 306, 308 includes a rack body 326 having first and second ends 328, 330. The rack body 326 is tapered between the respective first and second ends 328, 330, and the first end 328 has a first width smaller than a second width of the second end 330. The rack body 326 also includes first and second sides 332, 334 extending longitudinally between the first and second ends 328, 330. Rack teeth 336 are disposed on the first side 332, and a rack alignment feature 338 is disposed on and extends from the second side 334. The rack teeth 336 are adapted to meshingly engage teeth of the gear 310, and the rack alignment feature 338 is adapted to mate with the second channel portion 324, as described below.

For example, in an embodiment, the first gear rack 306 is adapted to be disposed in the first channel 316, with the rack body 326 disposed longitudinally in the first channel portion 322, and the rack alignment feature 338 disposed in the second channel portion 324. The cross-sectional shapes of the rack alignment feature 338 and the second channel portion 324 are matingly shaped or keyed to allow the first gear rack 306 to slide longitudinally in the first channel 316, and restrict horizontal movement of the first gear rack 306 relative to the first channel 316. As illustrated, the cross-sectional shapes of the rack alignment feature 338 and the second channel portion 324 are substantially "D" shaped, however, any other cross-sectional shapes may be used.

In a similar manner, the second gear rack 308 is adapted to be disposed in the second channel 318, with the rack body 326 is disposed longitudinally in the first channel portion 322, and the rack alignment feature 338 disposed in the second channel portion 324. The rack teeth 336 of each of the first and second gear racks 306, 306 also face each other. While the first and second gear racks 306, 308 are described as being slidable longitudinally in the respective first and second channels 316, 318, one or both of the first and second gear racks 106, 108 may be fixed in position to provide for horizontal and vertical alignment.

As describe above with respect to the hinge mechanism 100, both of the first and second gear racks 306, 308 are positioned with the first ends 328 facing in a first direction, and the second ends 330 facing in a second direction opposite the first direction.

The gear 310 includes a toothed portion 340 including gear teeth disposed circumferentially around the gear 310. A lug 342 protrudes from a first side of the toothed portion 340, and a fastener type head 344 is disposed on a second side of the toothed portion 340. The lug 342 is adapted to engage an aperture of the frame 202, as described above with respect to the hinge mechanism 100. The head 340 also includes a recess adapted to mate with a tool driver, such as, for example, a flat, Torx, Phillips, hex, or other type of tool driver.

As described above, the gear 310 is disposed in the housing 302 between the first and second gear racks 306, 308, with the toothed portion 340 in meshing engagement with the rack teeth 336 of both of the first and second gear racks 306, 308. Further, the head 344 is adapted to extend through a first aperture 346 in the housing 302 and be disposed and accessible through the second surface portion 314. Similarly, the lug 342 is adapted to extend through a second aperture 348 in the housing 302 and be disposed and extend through the first surface portion 312. The first and second apertures 346 and 348 are sized to provide clearance for the housing 302 to move in a side-to-side direction relative to the gear 310. For example, the first aperture 346 may be oblong and allow the housing 302 to move horizontally relative to the gear 310.

Figure 11:
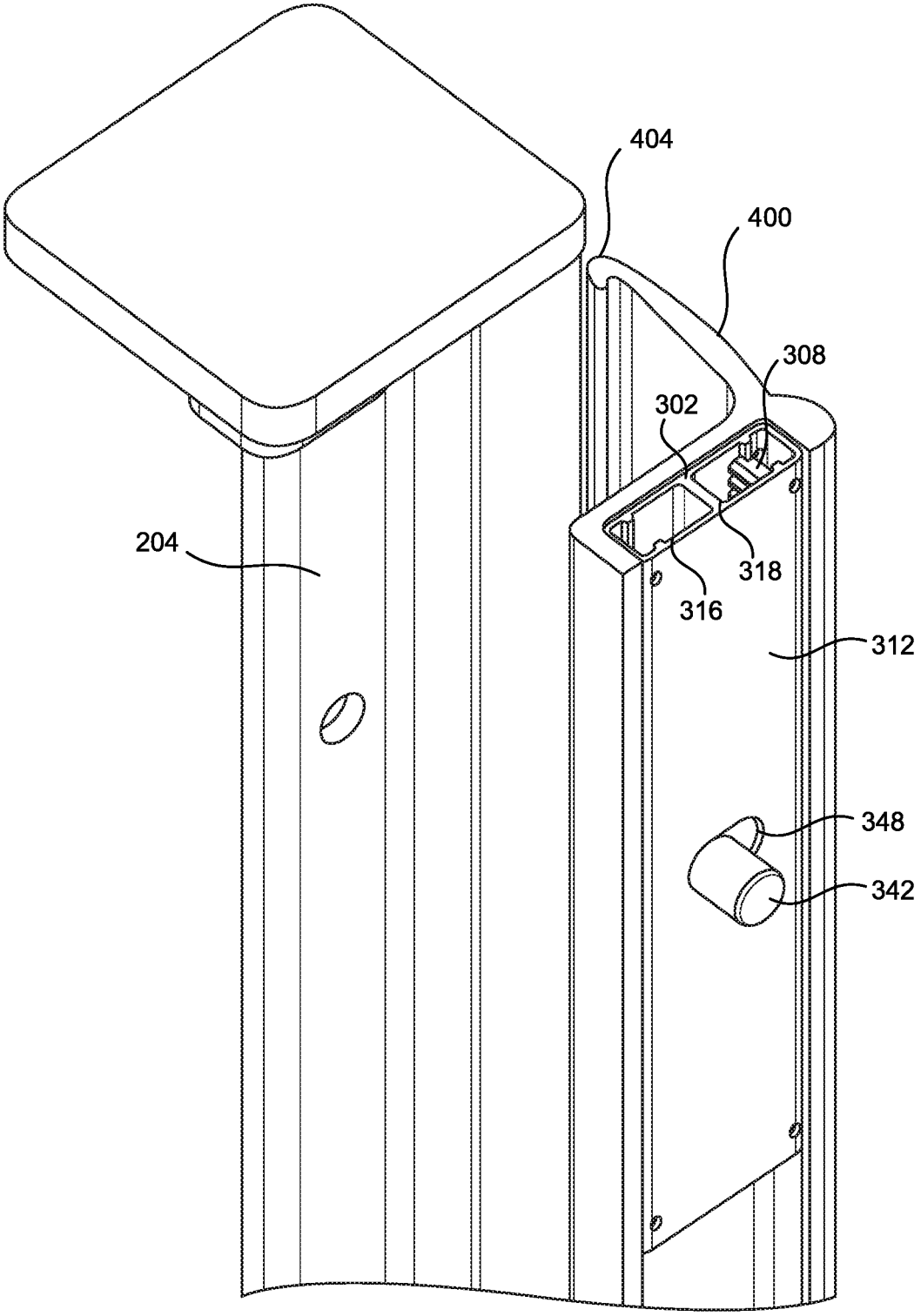
FIG. 11 is a partial perspective view of the adjustable hinge mechanism of FIG. 7 installed in a structure.

Referring to FIG. 11, in an embodiment, when the hinge mechanism 300 is assembled, the first and second gear racks 306, 308 are disposed in the respective first and second channels 316, 318 (as described above), and the gear 310 is disposed in the housing 302 between the first and second gear racks 306, 308 (as described above). The toothed portion 340 of the gear 310 may be engaged with rack teeth 336 of the second gear rack 308 proximal to the second end 330 of the second gear rack 308; and the toothed portion 340 of the gear 310 may also be engaged with rack teeth 336 of the first gear rack 306 proximal to the first end 328 of the first gear rack 306. This allows for rotation of the gear 310 in clockwise or counter-clockwise directions. Rotation of the gear 310 causes one of the first and second gear racks 306, 308 to move in the first direction, and the other to move in the second direction.

For example, in an embodiment, rotation of the head 344 of the gear 310 in the clockwise direction causes the first gear rack 306 to move in the second direction (such as downwardly relative to the housing 302) in the first channel 316, and the second gear rack 308 to move in the first direction (such as upwardly relative to the housing 302) in the second channel 318. Similarly, rotation of the head 344 of the gear 310 in the counter-clockwise direction causes the first gear rack 306 to move in the first direction (such as upwardly relative to the housing 302) in the first channel 316, and the second gear rack 308 to move in the second direction (such as downwardly relative to the housing 302) in the second channel 318.

As mentioned above, the lug 342 of the gear 310 is engaged with the frame 202, when the hinge mechanism 300 is installed. Further, the hinge mechanism 300 may be coupled to the hinge bracket 400 causing the hinge bracket 400 to move with the housing 302. Due to the tapered shapes of the first and second gear racks 306, 308, rotation of the gear 310, and thereby opposing movement of the first and second gear racks 306, 308 relative to one another, causes the housing 302 (and hinge bracket 400) to move in a side-to-side direction relative to the frame 202. This allows for alignment of the housing 302 (and hinge bracket 400) relative to the frame 202. Once desired alignment of the housing 302 (and hinge bracket 400) relative to the frame 202 is obtained by rotation of the gear 310, fasteners can be inserted into the housing 302 and/or hinge bracket 400, and frame 202 to releasably mount and hold the housing 302/hinge bracket 400 on the frame 202.

In an embodiment, a single hinge mechanism 100, 300 may include more than one set of a gear and first and second gear racks. For example, a first set may be disposed proximal to a first end of the frame, and a second set may be disposed proximal to a second end opposite the first end of the frame. One or more additional sets may be disposed between the first and second ends of the frame. This allows for adjustment at varying locations along the door and frame.

Similarly, more than one hinge mechanism 100, 300 may be used in mounting a door to a frame. For example, a first hinge mechanism 100, 300 may be disposed proximal to a first end of the frame, and a second hinge mechanism 100, 300 may be disposed proximal to a second end opposite the first end of the frame. One or more additional hinge mechanisms 100, 300 may be disposed between the first and second ends of the frame. This allows for adjustment at varying locations along the door and frame.

Further, the hinge mechanisms 100, 300 may be used to adjust vertical alignment by orienting the hinge mechanisms 100, 300 with a longitudinal axis of the hinge mechanism extending horizontally. It should be appreciated that a length and/or size of the hinge mechanisms 100, 300 may be changed to accommodate installation for vertical alignment. Accordingly, a combination of hinge mechanisms may be used to adjust horizontal and vertical alignment.

As used herein, the term "coupled" and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. An adjustable hinge mechanism, comprising:

a body including first and second channels;

first and second gear racks respectively disposed in the first and second channels, wherein each of the first and second gear racks has first and second ends and is tapered from the first end towards the second end; and a gear disposed between the first and second gear racks, wherein rotation of the gear causes the first gear rack to move in a first direction and the second gear rack to move in a second direction opposite the first direction.

2. The adjustable hinge mechanism of claim 1, wherein each of the first and second gear racks includes rack teeth adapted to meshingly engage gear teeth disposed on the gear.

3. The adjustable hinge mechanism of claim 1, wherein the first channel includes an inwardly extending flange forming first and second channel portions.

4. The adjustable hinge mechanism of claim 3, wherein the first gear rack includes a body portion and an alignment portion, and wherein the body portion is disposed in the first channel portion, and the alignment portion is disposed in the second channel portion.

5. The adjustable hinge mechanism of claim 1, wherein the gear includes a head accessible outside of the body, and wherein the head is adapted to be engaged by a tool drive.

6. The adjustable hinge mechanism of claim 5, wherein the gear includes a lug opposite the head and is adapted to engage a frame of a case.

7. The adjustable hinge mechanism of claim 1, wherein the body is adapted to pivotably couple to a door.

8. The adjustable hinge mechanism of claim 1, wherein the body is a housing that is adapted to couple to a hinge bracket.

9. An adjustable hinge mechanism, comprising:

a body including first and second channels;

first and second gear racks respectively disposed in the first and second channels, wherein each of the first and second gear racks has first and second ends and is tapered from a from the first end towards the second end, and each of the first and second gear racks includes rack teeth facing each other; and a gear including gear teeth disposed between the first and second gear racks and in meshing engagement with the rack teeth, wherein rotation of the gear causes the first gear rack to move in a first direction and the second gear rack to move in a second direction opposite the first direction.

10. The adjustable hinge mechanism of claim 9, wherein the first channel includes an inwardly extending flange forming first and second channel portions.

11. The adjustable hinge mechanism of claim 10, wherein the first gear rack includes a body portion and an alignment portion, and wherein the body portion is disposed in the first channel portion and the alignment portion is disposed in the second channel portion.

12. The adjustable hinge mechanism of claim 11, wherein a cross-sectional shape of the alignment portion is keyed to a cross-sectional shape of the second channel portion.

13. The adjustable hinge mechanism of claim 9, wherein the gear includes a head accessible outside of the body, and wherein the head is adapted to be engaged by a tool drive.

14. The adjustable hinge mechanism of claim 13, wherein the gear includes a lug opposite the head and is adapted to engage a frame of a case.

15. The adjustable hinge mechanism of claim 9, wherein the body is adapted to pivotably couple to a door.

16. The adjustable hinge mechanism of claim 9, wherein the body is a housing that is adapted to couple to a hinge bracket.

17. An adjustable hinge mechanism, comprising:

first and second gear racks, wherein each of the first and second gear racks has first and second ends and is tapered from the first end towards the second end; and a gear disposed between the first and second gear racks, wherein rotation of the gear causes the first gear rack to move in a first direction and the second gear rack to move in a second direction opposite the first direction.

18. The adjustable hinge mechanism of claim 17, wherein each of the first and second gear racks includes rack teeth adapted to meshingly engage gear teeth disposed on the gear.

* * * * *